US008711073B2

(12) United States Patent
Lee et al.

(10) Patent No.: US 8,711,073 B2
(45) Date of Patent: Apr. 29, 2014

(54) FLAT PANEL CRYSTAL DISPLAY EMPLOYING SIMULTANEOUS CHARGING OF MAIN AND SUBSIDIARY PIXEL ELECTRODES

(75) Inventors: Min Cheol Lee, Seoul (KR); Seung Hwan Moon, Yongin-Si (KR)

(73) Assignee: Samsung Display Co., Ltd. (KR)

( * ) Notice: Subject to any disclaimer, the term of this patent is extended or adjusted under 35 U.S.C. 154(b) by 873 days.

(21) Appl. No.: 12/175,961

(22) Filed: Jul. 18, 2008

(65) Prior Publication Data

US 2009/0021509 A1 Jan. 22, 2009

(30) Foreign Application Priority Data

Jul. 20, 2007 (KR) ..... 10-2007-0072997

(51) Int. Cl.
*G09G 3/36* (2006.01)

(52) U.S. Cl.
USPC ..... 345/90; 345/100

(58) Field of Classification Search
USPC ..... 345/90, 100
See application file for complete search history.

(56) References Cited

U.S. PATENT DOCUMENTS

| | | | | |
|---|---|---|---|---|
| 2003/0231735 | A1* | 12/2003 | Moon et al. | 377/64 |
| 2006/0176265 | A1* | 8/2006 | Kim et al. | 345/100 |
| 2006/0187175 | A1* | 8/2006 | Lo et al. | 345/100 |
| 2006/0208984 | A1* | 9/2006 | Kim et al. | 345/90 |
| 2006/0227095 | A1* | 10/2006 | Kim et al. | 345/100 |
| 2007/0132899 | A1* | 6/2007 | Cheng et al. | 349/38 |
| 2007/0188436 | A1* | 8/2007 | Wei et al. | 345/100 |
| 2008/0012842 | A1* | 1/2008 | Mori | 345/206 |

FOREIGN PATENT DOCUMENTS

| | | | |
|---|---|---|---|
| KR | 10-2006-0089829 | A | 8/2006 |
| KR | 10-2006-0107669 | A | 10/2006 |

* cited by examiner

*Primary Examiner* — Kwang-Su Yang
(74) *Attorney, Agent, or Firm* — Innovation Counsel LLP

(57) ABSTRACT

A display system includes a display panel having a plurality of pixel units, each of the pixel units having first and second divided pixel parts; a first driver for applying a first gate signal to the first divided pixel part; and a second driver for applying a second gate signal to the second divided pixel part, wherein the first and second drivers are integrally formed in the display panel and apply the first and second gate signals to be at least partially time-overlapped through independent driving.

17 Claims, 7 Drawing Sheets

FLAT PANEL CRYSTAL DISPLAY EMPLOYING SIMULTANEOUS CHARGING OF MAIN AND SUBSIDIARY PIXEL ELECTRODES

This application claims priority to and the benefit of Korean Patent Application No. 10-2007-0072997 filed on Jul. 20, 2007, whose disclosure is hereby incorporated by reference for all purposes as if fully set forth herein.

BACKGROUND

1. Field of Invention

The present disclosure of invention relates to flat panel displays, and more particularly, to liquid crystal displays (LCD's) in which each pixel unit is divided into a main pixel area and a subsidiary pixel area and the pixel-electrodes of these divided areas are to be charged to different potentials during a same horizontal line period.

2. Description of the Related Art

A liquid crystal display (LCD), which is one of a variety of different kinds of flat panel displays, is a device that forms an image by adjusting a transmitted amount of light supplied from a light source by using the optical anisotropy property of liquid crystal molecules and the polarization characteristics of a polarizer to control light transmitivity through each of color-filter covered pixel units. The process of controlling the orientation of the liquid crystal molecules includes charging one or more electrodes (pixel-electrodes) to a desired electrical potential. In recent years, use of liquid crystal displays has been increasingly widening because it has various features such as being lightweight, compact, offering high resolution, large screen sizes, and low power consumption.

However the conventional liquid crystal display (e.g., the kind with just one pixel-electrode per pixel unit) suffers from the drawback of having a relatively narrower viewing angle than that of other kinds of displays because it forms an image by using the light transmitted only along a main transmission axis of liquid crystal molecules in a main area of each pixel unit. Thus, in order to widen the viewing angle, various techniques have been proposed. One of the proposed techniques is referred to as the Super Patterned Vertical Alignment (SPVA) scheme. According to the SPVA scheme, the total area of each pixel unit is divided into a main pixel area (having a respective main pixel-electrode) and one or more subsidiary pixel areas (having respective subsidiary pixel-electrodes). The pixel-electrodes of the so divided pixel unit are often independently driven to respectively different charge potentials so as to create an electric field gradient within the pixel unit and thus orient the liquid crystal molecules therein along more than just one main axis. Accordingly, different charging voltages need to be applied to the divided electrode areas of the pixel unit so that the light transmission axes of the liquid crystal molecules in the pixel unit are oriented along various angles, so that the viewing angle of a given image can then be improved, and in particular, so that side visibility can be improved. In the conventional SPVA scheme, each pixel unit is generally connected to and driven by two independent gate lines and one data line (this is referred to as a 2G-1D cell structure).

However, when compared to the more conventional 1G-1D cell structure, the SPVA scheme suffers the drawback that it has more independent pixel-electrodes in need of independent charging than does the general scheme, and accordingly, it is difficult to suitably provide sufficient charging time of each independent electrode inside the pixel unit, particularly if the to-be-charged, total capacitance associated with the one or more subsidiary pixel areas is substantially greater than the to-be-charged, total capacitance associated with the main pixel area. For example, in a case where one pixel unit is divided into a single subsidiary pixel area (hereafter also "sub pixel") and a smaller main pixel area (hereafter also "main pixel", the charging time available for each subdivision of such a pixel unit is often reduced to a half (e.g., ½ of horizontal scan time 1H) of what is available to a conventional 1G-1D cell structure. As mentioned, it is often desirable that the subsidiary pixel and the main pixel are charged with data signals having different potentials respectively. However, when the charging times of the data signals are controlled to be equal (e.g., each getting just ½ of H), the respective main and subsidiary pixel electrodes may be undercharged or overcharged relative to the desired potentials for the respective main and subsidiary pixel electrodes. As a result of such insufficient charging time, the display quality such as side visibility and color impression may be one that is below expectation. Incidentally, the terms, subsidiary and main as used herein do not necessarily apply to optical importance of the respective pixel parts. Instead, for one subset of embodiments, the term subsidiary implies that this electrode will generally receive a data signal of relatively lower or subsidiary absolute magnitude (L-DATA) while the main part will receive a data signal of relatively higher or more absolute magnitude (H-DATA). Of course, for another subset of embodiments this fixed interrelation between applied data signals does not apply and then the terms, subsidiary and main become arbitrary designations rather than of any significant meaning.

SUMMARY

In accordance with one aspect of the present disclosure, a display system is provided in which turn-on ($V_{gON}$) gate signals are applied to gates of electrode-charging transistors (e.g., TFT's) of a divided pixel unit in a partially overlapping in time manner so that greater charging time is allocated to the subpixels of the divided pixel unit that have a greater total capacitance associated with them.

Further, per another aspect of the disclosure, turn-on gate signals can be applied to the respective gates of divided pixels with different durations of turn-on time per gate.

Furthermore, according to still another aspect, a display system is provided having improved display quality such as improved side visibility and/or color impression by driving the subpixel areas of divided pixels in an overlapping-in-time manner and causing different final potentials to develop on the subpixel areas of divided pixels according to a time-divisional manner.

According to an aspect of the present disclosure, there is provided a display system including: a display panel having a plurality of pixel units, each of the pixel units having at least first and second divided pixel parts (e.g., a main subpixel and a subsidiary subpixel); a first driver for applying a first gate signal to an electrode-charging transistor of the first divided pixel part; and a second driver for applying a second gate signal to an electrode-charging transistor of the second divided pixel part, wherein in one embodiment, the first and second drivers are integrally formed in the display panel according to an amorphous silicon gate (ASG) scheme and apply the first and second gate signals so as to cause turn-on times of the first and second divided pixel parts to be at least partially overlapped while a common data line is independently driven to different levels during times of overlap and nonoverlap.

In one embodiment, one driver includes a subsidiary gate clocks generator for generating first and second subsidiary gate clock signals in response to an external gate clock signal, and a plurality of first turn-on timing circuits (first shift register stages) for applying gate turn-on signals of respective first durations to the second divided pixel parts (the subsidiary subpixels) in response to the first and second subsidiary gate clock signals. In addition, the other driver may include a main gate clocks generator for generating first and second main gate clock signals in response to the external gate clock signal, a plurality of main application timing circuits (second shift register stages) for applying turn-on gate signals to the first divided pixel parts (the main subpixels) in response to the first and second main gate clock signals, and a plurality of reset timing circuits (third shift register stages) for defining a duration of active time turn-on of the plurality of the main application timing circuits (the second shift register stages).

The main application timing and reset timing circuits may be intermingled in the other driver so that each main application timing circuit alternates with n reset timing circuits and the timing slots consumed by the n+1 circuits defines a token shifting period. Thus, the whole number, n of interposed reset timing circuits used with each main application timing circuit defines a duration of time out of the token period in which the main application timing circuit actively applies a turn-on gate voltage to be 1/(n+1) of the total token shifting period.

In one embodiment, the main application timing and reset timing circuits may be provided in the other driver so that they alternate with each other one by one. Thus, the reset timing circuit may control a duration active turn-on application time of the preceding main application timing circuit to be ½ of the total token shifting period in the case where n equals 1.

Odd numbered ones of the main application timing circuits may output their respective turn-on gate signal in response to the first main gate clock signal, and even numbered ones of the main application timing circuits thereof may output their respective turn-on gate signal in response to the second main gate clock signal.

The first and second main gate clock signals may respectively have opposite phases. In one embodiment, the first and second gate clock signals of the subsidiary driver have a period corresponding to one horizontal scan period (1H) of the display and the first and second gate clock signals of the second main driver have double the frequency, in other words a period corresponding to ½ the horizontal scan period.

The first and second drivers may be integrally both provided at one side of the display panel, or they may be respectively disposed at opposed sides of the display panel.

The device may further include a signal controller for supplying first and second control signals to the first and second drivers, respectively, each of the first and second control signals including a gate clock signal and a vertical synchronization start signal.

The device may further include a data driver for applying data signals having different potentials corresponding to the first and second divided pixel parts in a time-divisional manner.

The data driver may apply a lower absolute value magnitude of voltage data signal to the first divided pixel part and a comparatively higher absolute value magnitude of voltage data signal to the second divided pixel part.

The display panel may include a liquid crystal layer.

BRIEF DESCRIPTION OF THE DRAWINGS

The accompanying drawings, which are included to provide a further understanding of the disclosure and are incorporated in and constitute a part of this application and may help to explain various principles of the disclosure.

DETAILED DESCRIPTION

Figure 1:
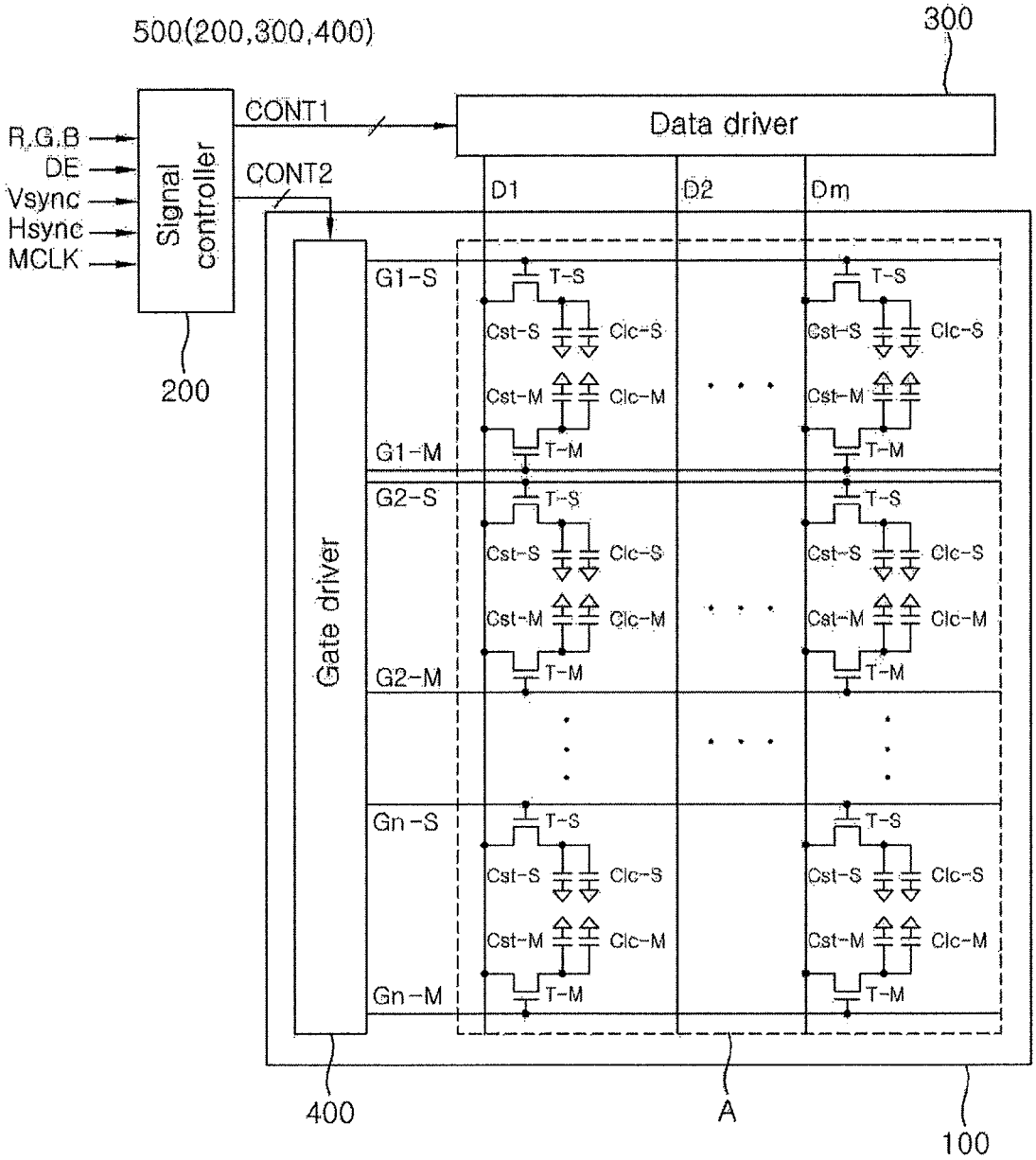
FIG. 1 is a block diagram illustrating a liquid crystal display according to a first embodiment.

Hereinafter, exemplary embodiments will be described in detail with reference to the accompanying drawings. However, the present disclosure is not to be viewed as being limited to the embodiments disclosed in detail below. These embodiments are provided only for illustrative purposes and for easier understanding by those skilled in the art. Throughout the drawings, like reference numerals may be used to designate like or similar elements.

FIG. 1 is a block diagram illustrating a liquid crystal display according to a first embodiment 100-200-300.

Referring to FIG. 1, a liquid crystal display according to this embodiment includes a liquid crystal display panel 100 having a plurality of pixel units arranged in a matrix form in a display area A thereof, and a liquid crystal driving circuit 500 for controlling operations of the pixel units. The liquid crystal driving circuit 500 includes a signal controller 200, a data driver 300, and a gate driver 400, wherein the illustrated embodiment, the gate driver 400 is monolithically integrated as part of the display panel 100 and adjacent to the display area, A. The liquid crystal driving circuit 500 further includes a gray scale voltage generator (not shown, but understood to couple to unit 300) for supplying a gray scale voltage to the data driver 300, and a driving voltage generator (not shown, but understood to couple to unit 400) for supplying a driving voltage to the gate driver 400. Here, one or more portions of the liquid crystal driving circuit 500, i.e., the data driver 300 and the gate driver 400, may be integrally embedded into a substrate of the liquid crystal display panel through use of a thin film circuit forming scheme such as one using amorphous silicon thin-film transistors (aTFT's), i.e., an amorphous silicon gate (ASG) scheme, which will be described later. In other words, the circuitry of circuit 500 may be implemented with use of amorphous silicon thin-film transistors (aTFT's) that are monolithically formed as an integrated part of the display panel 100. Since panel area is often limited, the aTFT's on the panel are generally of relatively small and equal size. However, as mentioned above, the total areas of main and subsidiary electrodes may not be of equal size relative to one another, and in one particular class of embodiments, the to-be-charged, total capacitance ($C_{LC\text{-}S}$ plus $C_{ST\text{-}S}$) associated with the subsidiary pixel areas is substantially greater than the to-be-charged, total capacitance ($C_{LC\text{-}M}$ plus $C_{ST\text{-}M}$) associated with the main pixel area even though the aTFT's for charging these different capacitances are of substantially equal size (e.g., equal channel widths).

As shown for the embodiment of FIG. 1, the liquid crystal display panel 100 includes a plurality of primary gate lines G1-M to Gn-M (main gate lines) and secondary G1-S to Gn-S (subsidiary gate lines), a plurality of data lines D1 to Dm intersecting the primary and secondary gate lines, and a plurality of pixel units having pixel areas defined within the boundaries of respective intersections of the main gate lines and the data lines. In particular, each pixel unit of the illustrated embodiment includes a plurality of divided pixels areas. The specific dimensions and geometries of the divided pixels areas may vary from application to application and may include interdigitated fingers as well as separate islands within each pixel area. The specific dimensions of the TFT's that selectively couple charge to these divided pixel parts may vary from application to application. However, as mentioned above, in one class of embodiments, the to-be-charged, total capacitance ($C_{LC\text{-}S}$ Plus $C_{ST\text{-}S}$) associated with the subsidiary pixel areas is substantially greater than the to-be-charged, total capacitance ($C_{LC\text{-}M}$ plus $C_{ST\text{-}M}$) associated with the main pixel area. On the other hand, the aTFT's used for charging respective ones of these different capacitances are of substantially equal size (e.g., equal channel widths). More specifically, each illustrated pixel unit includes a first sub-pixel part having a respective subsidiary thin film transistor T-S where the effective capacitances that are charged or discharged by T-S include a subsidiary liquid crystal capacitor $C_{lc\text{-}S}$ and a subsidiary storage capacitor $C_{st\text{-}S}$. The pixel unit also includes a respective main pixel part having a corresponding main thin film transistor, T-M, where the effective capacitances that are charged or discharged by T-M include a main liquid crystal capacitor $C_{lc\text{-}M}$ and a main storage capacitor $C_{st\text{-}M}$. Although not shown in detail each of the liquid crystal capacitors Clc-S and Clc-M is understood to include a respective pixel electrode (not shown) forming one plate of the capacitor and a portion of a common electrode (not shown) forming another plate of the capacitor with a portion of the liquid crystal material layer being disposed therebetween to serve as the dielectric. When either of the thin film transistors, T-S or T-M is turned on (rendered conductive) by application of a turn-on voltage to its respective gate, a data signal voltage is charged from the corresponding data line (Dm) and through the corresponding, turned-on TFT into the respective liquid crystal capacitor to control alignment of molecules in the liquid crystal material layer within that capacitor. Each of the storage capacitors Cst-S and Cst-M may include a dielectric protection film between a pixel electrode and a storage electrode which overlap one on the other, thereby serving to maintain a data signal charged in the liquid crystal capacitor Clc-S or Clc-M until a next data signal is charged into the liquid crystal capacitor during a next respective horizontal line period (1H) of a next image frame. Of course, the storage capacitors Cst-S and Cst-M acting as supplements for the respective liquid crystal capacitors Clc-S and Clc-M may be optionally omitted. Generally, it is desirable to apply different voltages of corresponding different data signals (or image signals) respectively to each of the subsidiary subpixels and the main subpixels in each pixel unit respectively. For example, in one image state it may be desirable to apply a comparatively low voltage data signal (e.g., see L-DATA of FIG. 3) to the subsidiary pixel capacitor, and a relatively higher voltage data signal (e.g., see H-DATA of FIG. 3) to the main pixel capacitor. As a result of these different voltage levels, different electric fields are formed in the main and subsidiary pixel unit areas and the alignments of liquid crystal molecules in these areas are thereby controlled to provide a variety of orientation angles, whereby side visibility can be improved if desired, by virtue of the distribution of alignment axes of the liquid crystal molecules in the pixel unit. Of course, alternatively, it may be desirable in another image state to apply a comparatively high voltage data signal (e.g., H-DATA) to the subsidiary pixel and to apply a comparatively lower voltage data signal (e.g., L-DATA) to the main pixel to achieve a correspondingly different visual effect; the point being that the main and subsidiary pixel-electrodes are often supplied within a given frame (within a 1H charge period) with different voltage levels to which they are to be charged through their respective TFT's.

As the pixel unit is divided into the subsidiary pixel area (or in one exemplary class of embodiments, the low potential receiving pixel electrode) and the main pixel area (or in one exemplary class of embodiments, the high potential receiving pixel electrode), the plurality of gate lines G1-S to Gn-S and G1-M to Gn-M are also divided into corresponding subsidiary gate lines G1-S to Gn-S and main gate lines G1-M to Gn-M. The gate terminals of the subsidiary thin film transistors T-S are connected to the subsidiary gate lines G1-S to Gn-S, while source terminals thereof are connected to the data lines D1 to Dm, and drain terminals thereof are connected to subsidiary pixel electrodes forming the subsidiary liquid crystal capacitors Clc-S and optionally, the subsidiary storage capacitors Cst-S. Here, the subsidiary thin film transistors T-S operate in response to a gate turn-on voltage, Von applied to the subsidiary gate lines G1-S to Gn-S and couple the data signals of the data lines D1 to Dm to the secondary pixel electrodes of the subsidiary liquid crystal capacitors Clc-S during the time that Von is applied to the corresponding subsidiary gate lines. Further, gate terminals of the main thin film transistors T-M are connected to the main gate lines G1-M to Gn-M, while source terminals thereof are connected to the data lines D1 to Dm, and drain terminals thereof are connected to the primary pixel electrodes forming the main liquid crystal capacitors Clc-M and optionally, the main storage capacitors Cst-M. Here, the main thin film transistors T-M operate in response to a gate turn-on voltage, Von applied to the main gate lines G1-M to Gn-M and couple the data signals of the data lines D1 to Dm to the corresponding main pixel electrodes (to the main liquid crystal capacitors Clc-M) during the time that Von is applied to the corresponding main gate lines. That is, the aforementioned pixel unit is driven by signals on the two gate lines G-M and G-S, on the data line D, and in accordance with responses of the two thin film transistors T-M and T-S to the signals applied to their gate and source terminals.

Meanwhile, the liquid crystal display panel 100 includes a liquid crystal layer (not shown) formed between upper and lower substrates (not shown) adhered together and structured to be spaced apart from each other. In the liquid crystal layer of this embodiment, the liquid crystal molecules may be oriented so that a longitudinal axis thereof is perpendicular to the upper and lower substrates, and the liquid crystal layer may be formed in a multi-domain structure. To this end, a liquid crystal orientation control means, such as a grooved pattern or a bump pattern, may be provided on at least one of opposite surfaces of the upper and lower substrates, e.g., at least one of the common electrode and the pixel electrode. In one embodiment, each pixel unit including the subsidiary pixel and the main pixel thereof may be driven to uniquely display one of three primary colors (i.e., red, green and blue) to a desired grayscale level of intensity. To this end, the pixel unit may include a respective one of a red, green or blue color filter (not shown) disposed in the light transmission path of the pixel unit.

The signal controller 200 receives an input image signal and an input control signal from an external graphics controller (not shown). For example, the input image signal includes image data fields R, G and B, and the input control signal includes a vertical synchronization signal Vsync, a horizontal synchronization signal Hsync, a main clock MCLK and a data enable signal DE. The signal controller 200 also processes the input image signal to be suitable for an operational condition of the liquid crystal display panel 100, and generate internal image data R, G and B, a data control signal CONT1 and a gate control signal CONT2. The signal controller 200 then sends the image data R, G and B and the data control signal CONT1 to the data driver 300, and sends the gate control signal CONT2 to the gate driver 400. Here, the respective colored image data signals: R, G and B may be rearranged depending on specific pixel unit and/or color filter arrangements within the liquid crystal display panel 100 and corrected by an image correction circuit. The data control signal CONT1 includes a horizontal synchronization start signal STH indicating start of transmission of image data, a load signal LOAD instructing to apply the data signal to a corresponding data line, a reverse signal RVS for reversing a polarity of a data voltage with respect to the common voltage (applied to the common electrode), and a data clock signal DCLK. The gate control signal CONT2 includes a vertical synchronization start signal STV indicating start of output of the gate on voltage Von, a gate clock signal CKV, and an output enable signal OE.

In particular, as the pixel unit is divided into the main pixel and the subsidiary pixel in the discussed embodiment, the signal controller 200 of this embodiment generates as part of gate control signal CONT2, a pair of vertical synchronization start signals, i.e., a first vertical synchronization start signal STVi-1 and a second vertical synchronization start signal STVi-2, and a pair of gate clock signals, i.e., a first gate clock signal CKVi-1 and a second gate clock signal CKVi-2, to control timings for driving the main pixel and the subsidiary pixel independently, and the signal controller 200 outputs these signals to the gate driver 400.

The gray scale voltage generator (not shown) may divide a reference gamma-corrected voltage input from an external power supply to generate (e.g., by way of extrapolation) a multilevel gray scale voltage. In this case, the number of levels of the gray scale voltages depends on the number bits in each of the image data fields, R, G and B. For example, when each of the image data R, G and B has 8 bits, the gradation voltage has 256 levels. The gray scale voltage generator of this embodiment may generate a pair of gray scale voltages having different polarities, i.e., a positive (+) gray scale voltage and a negative (−) gray scale voltage and provide the gray scale voltages to the data driver 300.

The data driver 300 converts digital image data into analog image data using the gray scale voltage from the gray scale voltage generator (not shown), and applies the analog image data to the data lines D1 to Dm as the respective data signals during their allocated time slots. The data driver 300 of this embodiment divides one frame in a time-divisional manner, and in one example, applies a lower voltage data signal (e.g., see L-DATA of FIG. 3) to the subsidiary pixel and a higher voltage data signal (e.g., see H-DATA of FIG. 3) to the main pixel during their respective time slots and via the associated data line (D1-Dm). At this time, the data signals may be generated using the positive gray scale voltage or the negative gradation voltage. The data signals may be reversed in polarity according to the reverse signal RVS of the signal controller 200 to be applied to the data lines D1 to Dm. That is, a pair of the data signals having positive (+) and negative (−) polarities with respect to a common voltage Vcom may be alternately applied dot by dot, line by line, column by column or frame by frame as may be deemed appropriate for avoiding deleterious effects of continuously applying a same polarity drive signal to the liquid crystal capacitors of the display panel.

The driving voltage generator (not shown) may generate and output various driving voltages required for driving the liquid crystal display panel 100 using external power input from the external power supply. For example, the driving voltage generator generates a gate turn-on voltage, Von for turning on the thin film transistor (TFT) and a gate turn-off voltage, Voff for turning off the thin film transistor to provide them to the gate driver 400, and generates the common voltage Vcom to apply it to the common electrode and the storage electrode.

The gate driver 400 is enabled by the vertical synchronization start signal STV, and sequentially applies an analog signal selected from the set of the gate turn-on voltage, Von and the gate turn-off voltage, Voff from the driving voltage generator to sequential ones of the main and subsidiary gate lines, G1 to Gn as a gate signal in synchronization with the gate clock signal CKV. The gate driver 400 includes a first driver 410 (FIG. 2A) for applying the gate signal to the subsidiary gate lines G1-S to Gn-S, and a second driver 420 (FIG. 2B) for applying the gate signal to the main gate lines G1-M to Gn-M. In one embodiment, the first and second drivers 410 and 420 are disposed at one outer side of the display area A, wherein they may be formed together with the pixels in an integrated ASG scheme. For example, the first and second drivers 410 and 420 may be integrally formed together with the pixel units on the TFT array substrate for example at one side of an edge of the lower substrate on which the thin film transistors of the liquid crystal display panel 100 are formed. Thus, manufacturing cost reduction can be achieved by reducing the number of discrete external parts.

Figure 2A:
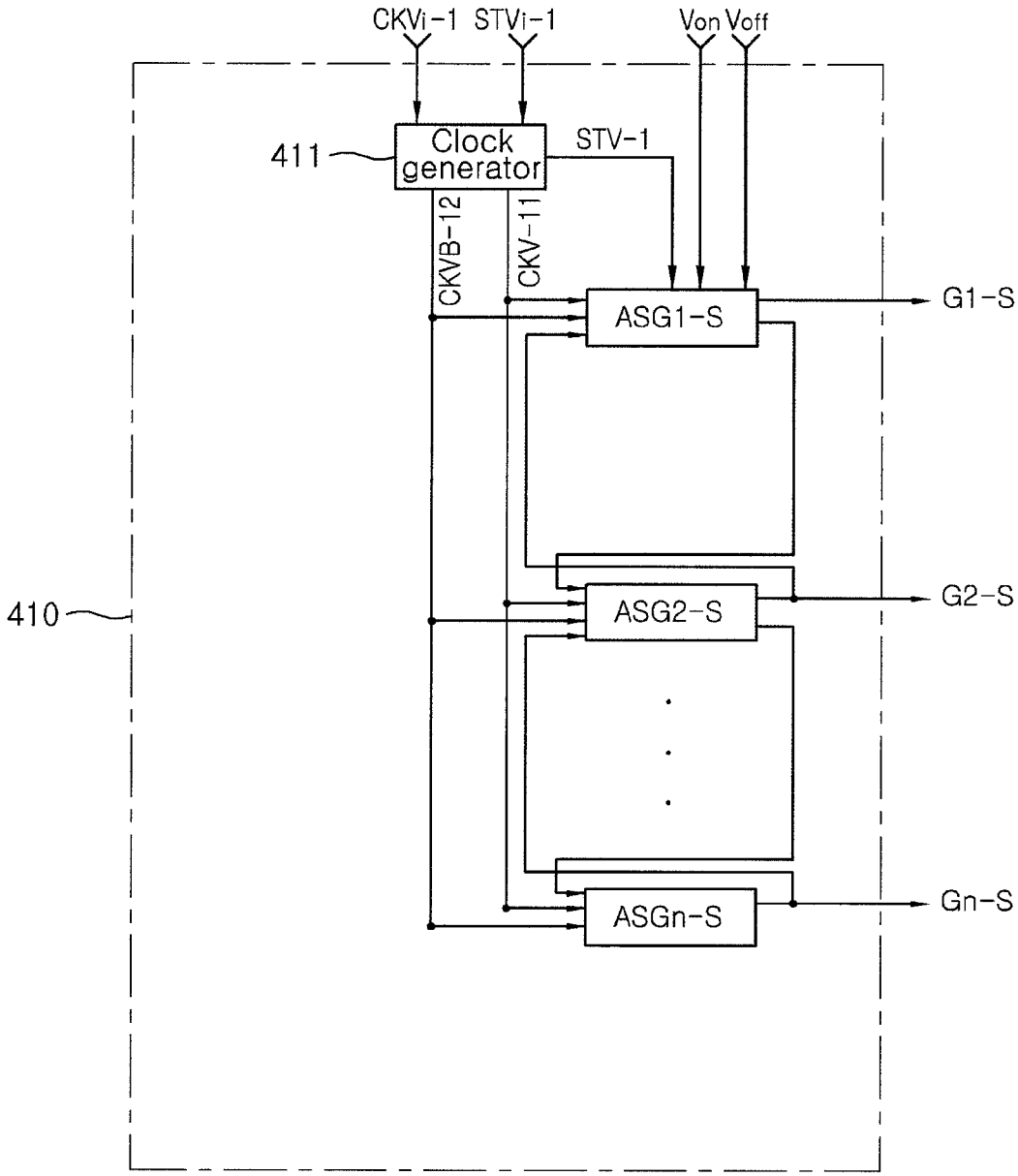
FIG. 2A is a block diagram illustrating a first driver (subsidiary driver) of a gate driver according to the first embodiment.
Figure 2B:
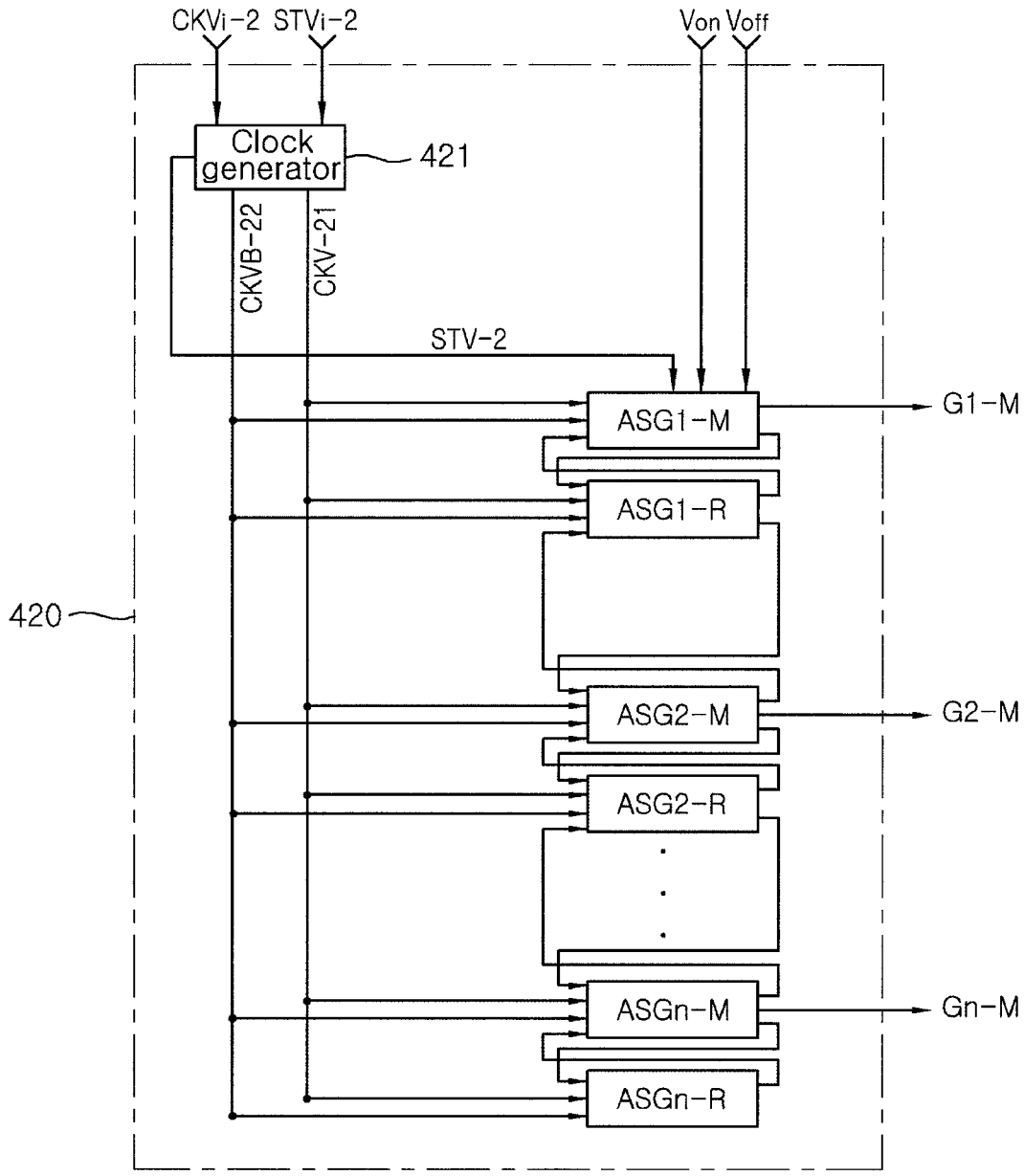
FIG. 2B is a block diagram illustrating a second driver (main driver) of the gate driver according to the first embodiment.
Figure 3:
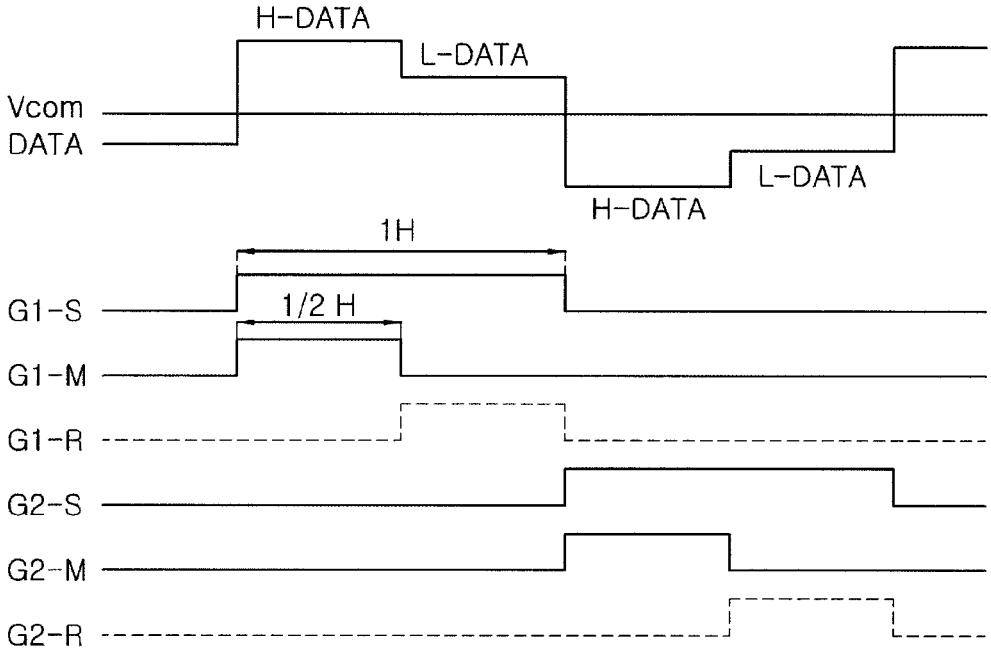
FIG. 3 is an operation timing diagram of the gate driver according to the first embodiment.

FIG. 2A is a block diagram illustrating the first driver of the gate driver according to the first embodiment. FIG. 2B is a block diagram illustrating the second driver of the gate driver according to the first embodiment. FIG. 3 is an operation timing diagram of the gate driver according to the first embodiment. Here, the first driver of FIG. 2A and the second driver of FIG. 2B are shown separately for convenience of illustration, but in one embodiment, they are actually arranged with their shift register stages physically intermingled along one side of the liquid crystal display panel 100 in accordance with FIG. 1.

Referring to FIG. 2A, the first driver 410 includes a gate clock generator 411 and a plurality of driving amorphous silicon gate circuits ASG1-S to ASGn-S (e.g., shift register stages). The gate clock generator 411 generates first and second internal gate clock signals CKV-11 and CKVB-12 in response to the first external gate clock signal CKVi-1, and generates a first internal vertical synchronization start signal STV-1 in response to the first external vertical synchronization start signal STVi-1. The plurality of driving amorphous silicon gate circuits ASG1-S to ASGn-S is enabled by the first internal vertical synchronization start signal STV-1, and apply the gate signal to the sub gate lines G1-S to Gn-S in response to the first internal gate clock signal CKV-11 or the second internal gate clock signal CKVB-12. The driving amorphous silicon gate circuits ASG1-S to ASGn-S are connected subordinately with one another (to thereby defining a shift register) so that each succeeding driving amorphous silicon gate circuit in the sequence is enabled in ripple down manner by an output signal, i.e., a carry signal, of the preceding driving amorphous silicon gate circuit, and so that the preceding driving amorphous silicon gate circuit is disabled by an output signal, i.e., a reset signal, of the succeeding driving amorphous silicon gate circuit. The driving amorphous silicon gate circuits ASG1-S to ASGn-S (shift register stages) according to this embodiment may use the gate output level, i.e., the gate on voltage Von, as the carry signal assertion and the reset signal assertion.

The operation of the first driver having the aforementioned configuration will now be described with reference to FIGS. 2A and 3. First, the gate clock generator 411 applies the first and second internal gate clock signals CKV-11 and CKVB-12 generated based on the first external gate clock signal CKVi-1, and the first internal vertical synchronization start signal STV-1 generated based on the first external vertical synchronization start signal STVi-1 to the first driving amorphous silicon gate ASG1-S. At this time, the first and second internal gate clock signals CKV-11 and CKVB-12 respectively have opposite phases and have voltage levels corresponding to the gate on voltage Von and the gate off voltage Voff. That is, the first and second internal gate clock signals CKV-11 and CKVB-12 have the voltage level corresponding to the gate on voltage Von in a high section, and the voltage level corresponding to the gate off voltage Voff in a low section. The first driving amorphous silicon gate circuit ASG1-S (the first one in the sequence of the shift register stages) is enabled by the first internal vertical synchronization start signal STV-1 and outputs the gate on voltage Von to the first sub gate line G1-S in the high section of the first internal gate clock signal CKV-11 (or the second internal gate clock signal CKVB-12). The second to n-th driving amorphous silicon gate circuits ASG2-S to ASGn-S are enabled by gate outputs of the preceding driving amorphous silicon gate circuits ASG1-S to ASGn-1-S and sequentially output the gate on voltage Von to the second to n-th sub gate lines G2-S to Gn-S in response to the first internal gate clock signal CKV-11 (or the second internal gate clock signal CKVB-12). At this time, the first to n−1 driving amorphous silicon gate circuits ASG1-S to ASGn-1-S are reset by gate outputs of the succeeding driving amorphous silicon gate circuits ASG2-S to ASGn-S.

In the aforementioned operation, the driving amorphous silicon gate circuits ASG1-S to ASGn-S may output the gate off voltage Voff while they are not outputting the gate on voltage Von. In addition, odd numbered driving amorphous silicon gate circuits ASG1-S, ASG3-S, . . . may output the gate on voltage Von in response to the first internal gate clock signal CKV-11, and even numbered driving amorphous silicon gate circuits ASG2-S, ASG4-S, . . . may output the gate on voltage Von in response to the second internal gate clock signal CKVB-12. Meanwhile, since it is desirable in the embodiment where subsidiary pixels are of larger capacitance, that the output of the driving amorphous silicon gate circuits ASG1-S to ASGn-S, which output the gate turn-on voltage, Von to the subsidiary pixels, is maintained during one horizontal line period (1H) of the currently displayed image frame, clock periods of the first and second internal gate clock signals CKV-11 and CKVB-12 may be the same as the one horizontal period (1H). Accordingly, the driving amorphous silicon gate circuits ASG1-S to ASGn-S of the first driver 410 sequentially output the gate turn-on voltage, Von for periods of one horizontal period (1H) each as is indicated in the voltage versus time plots of FIG. 3 for G1-S, G2-S, etc.

Referring to FIG. 2B, the second driver 420 includes a gate clock generator 421, a plurality of driving amorphous silicon gate circuits ASG1-M to ASGn-M, and a plurality of reset amorphous silicon gate circuits ASG1-R to ASGn-R. The gate clock generator 421 generates first and second internal gate clock signals CKV-21 and CKVB-22 in response to the second external gate clock signal CKVi-2 and generates a second internal vertical synchronization start signal STV-2 in response to the second external vertical synchronization start signal STVi-2. The plurality of driving amorphous silicon gate circuits ASG1-M to ASGn-M is enabled by the second internal vertical synchronization start signal STV-2, and apply the gate signal to the main gate lines G1-M to Gn-M in response to the first internal gate clock signal CKV-21 or the second internal gate clock signal CKVB-22. The plurality of reset amorphous silicon gate circuits ASG1-R to ASGn-R controls a duration time of the plurality of driving amorphous silicon gate circuits ASG1-M to ASGn-M. As described above, the driving amorphous silicon gate circuits ASG1-M to ASGn-M and the reset amorphous silicon gate circuits ASG1-R to ASGn-R are connected subordinately (as a sequential line selecting shift register) so that the succeeding driving amorphous silicon gate circuit is enabled by an output signal, i.e., a carry signal, of the preceding driving amorphous silicon gate circuit, and the preceding driving amorphous silicon gate circuit is disabled by an output signal, i.e., a reset signal, of the succeeding driving amorphous silicon gate circuit. The driving amorphous silicon gate circuits ASG1-M to ASGn-M and the reset amorphous silicon gate circuits ASG1-R to ASGn-R according to this embodiment may use the gate on voltage Von as the carry signal and the reset signal.

In particular, the reset amorphous silicon gate circuits ASG1-R to ASGn-R are not connected to the main gate lines G1-M to Gn-M, but control a duration time of the preceding driving amorphous silicon gate circuits ASG1-M to ASGn-M connected to the main gate lines G1-M to Gn-M. For example, the second driver 420 according to this embodiment includes the driving amorphous silicon gate circuits ASG1-M to ASGn-M and the reset amorphous silicon gate circuits ASG1-R to ASGn-R arranged alternately one after the next, and controls the duration time of the preceding driving amorphous silicon gate circuits to be a half a horizontal line period (H/2). However, the present disclosure is not limited to subdividing the time of drive overlap to one half. The driving and reset amorphous silicon gate circuits may be arranged so that one driving amorphous silicon gate more generally alternates with n reset amorphous silicon gate circuits (where n=1, 2, 3, etc) thereby the duration time of the preceding driving amorphous silicon gate circuit is controlled to be 1/(n+1). Here, n denotes a positive integer. So in the case where n=1, the preceding driving amorphous silicon gate circuit is controlled to be on for 1/(1+1) of the horizontal line period (H).

The operation of the second driver having the aforementioned configuration will now be described with reference to FIGS. 2B and 3. In FIG. 3, a plot line G1-R denotes a virtual output timing of the first reset amorphous silicon gate circuit ASG1-R, and a plot line G2-R denotes a virtual output of the second reset amorphous silicon gate circuit ASG2-R.

First, the gate clock generator 421 applies the first and second internal gate clock signals CKV-21 and CKVB-22 generated based on the second external gate clock signal CKVi-2 and the second internal vertical synchronization start signal STV-2 generated based on the second external vertical synchronization start signal STVi-2 to the first driving amorphous silicon gate ASG1-M. At this time, the first and second internal gate clock signals CKV-21 and CKVB-22 respectively have opposite phases and have voltage levels corresponding to the gate on voltage Von and the gate off voltage Voff. The first driving amorphous silicon gate ASG1-M is enabled by the second internal vertical synchronization start signal STV-2 and outputs the gate on voltage Von to the first main gate line G1-M in a high section of the first internal gate clock signal CKV-21 (or the second internal gate clock signal CKVB-22). The first reset amorphous silicon gate circuit ASG1-R is enabled by a gate output of the first driving amorphous silicon gate circuit ASG1-M and resets the first driving amorphous silicon gate circuit ASG1-M in response to the first internal gate clock signal CKV-21 (or the second internal gate clock signal CKVB-22). Then, the second driving amorphous silicon gate circuit ASG2-M is enabled by a gate output of the first reset amorphous silicon gate circuit ASG1-S and outputs the gate on voltage Von to the second main gate line G2-M in response to the first internal gate clock signal CKV-21 (or the second internal gate clock signal CKVB-22). The second reset amorphous silicon gate ASG2-R is enabled by a gate output of the second driving amorphous silicon gate ASG1-M and resets the second driving amorphous silicon gate ASG2-M in response to the first internal gate clock signal CKV-21 (or the second internal gate clock signal CKVB-22). In this way, all the driving amorphous silicon gate circuits ASG1-M to ASGn-M and the reset amorphous silicon gate circuits ASG1-R to ASGn-R sequentially operate as a unified shift register and output the gate on voltage Von to all the main gate lines G1-M to Gn-M for a time duration corresponding to 1/(n+1) of the horizontal line period (H).

In the aforementioned operation, the driving amorphous silicon gate circuits ASG1-M to ASGn-M may output the gate off voltage Voff while they are not outputting the gate on voltage Von. Odd numbered driving amorphous silicon gate circuits ASG1-M, ASG3-M, . . . may output the gate on voltage Von in response to the first internal gate clock signal CKV-21 and even numbered driving amorphous silicon gate circuits ASG2-M, ASG4-M, . . . may output the gate on voltage Von in response to the second internal gate clock signal CKVB-22. Since the driving amorphous silicon gate circuits ASG1-M to ASGn-M of the second driver 420 are reset by the succeeding reset amorphous silicon gate circuits ASG1-R to ASGn-R, they output the gate on voltage Von only during a half the one horizontal period (1H). Thus, it is possible to control a charging time of a fast charging high data signal H-DATA to be shorter than that of a slow charging low data signal L-DATA, i.e., to be a half the charging time of the low data signal L-DATA. Note that for the embodiment where the subsidiary subpixel has substantially higher capacitance than the main subpixel, that the subsidiary subpixel is first fast charged by the H-DATA level towards its desired final state and then charged by the subsequent L-DATA level during the remainder of the charging period (1H) so as to be driven towards its desired final charged state. Note in addition, since the second driver 420 includes at least twice as many amorphous silicon gate circuits ASG1-S to ASGn-S and ASG1-R to ASGn-R as the first driver 410, the internal gate clock signals CKV-21 and CKVB-22 of the second driver 420 should have at least twice as high operational frequency as the internal gate clock signals CKV-11 and CKVB-12 of the first driver 410 in order to synchronize the operation timing of the amorphous silicon gate circuits. For example, when the liquid crystal display of this embodiment is applied to a TV product, the internal gate clock signals CKV-11 and CKVB-12 of the first driver 410 may be adjusted to 60 Hz and the internal gate clock signals CKV-21 and CKVB-22 of the second driver 420 may be adjusted to 120 Hz.

In the meantime, the first and second drivers 410 and 420 may operate independently in order to drive the sub pixel and the main pixel in an overlapping manner. Accordingly, the signal controller 200 may output a pair of gate control signals CONT2, i.e., the first external gate clock signal CKVi-1 and the first external vertical synchronization start signal STVi-1 for controlling the first driver 410, and the second external gate clock signal CKVi-2 and the second external vertical synchronization start signal STVi-2 for controlling the second driver 420. It is also preferred that a pair of signal lines for transferring the gate control signals CONT2 are provided between the signal controller 200 and the gate driver 400.

Second Embodiment

The present disclosure is not limited to the above first description. In an alternate embodiment, a plurality of gate drivers may be provided at both sides of the liquid crystal display panel 700 (FIG. 4) to apply gate signals to the gate lines. The liquid crystal display according to a second embodiment will now be described. In this case, a description of the same features as in the first embodiment will be omitted or briefly described.

Figure 4:
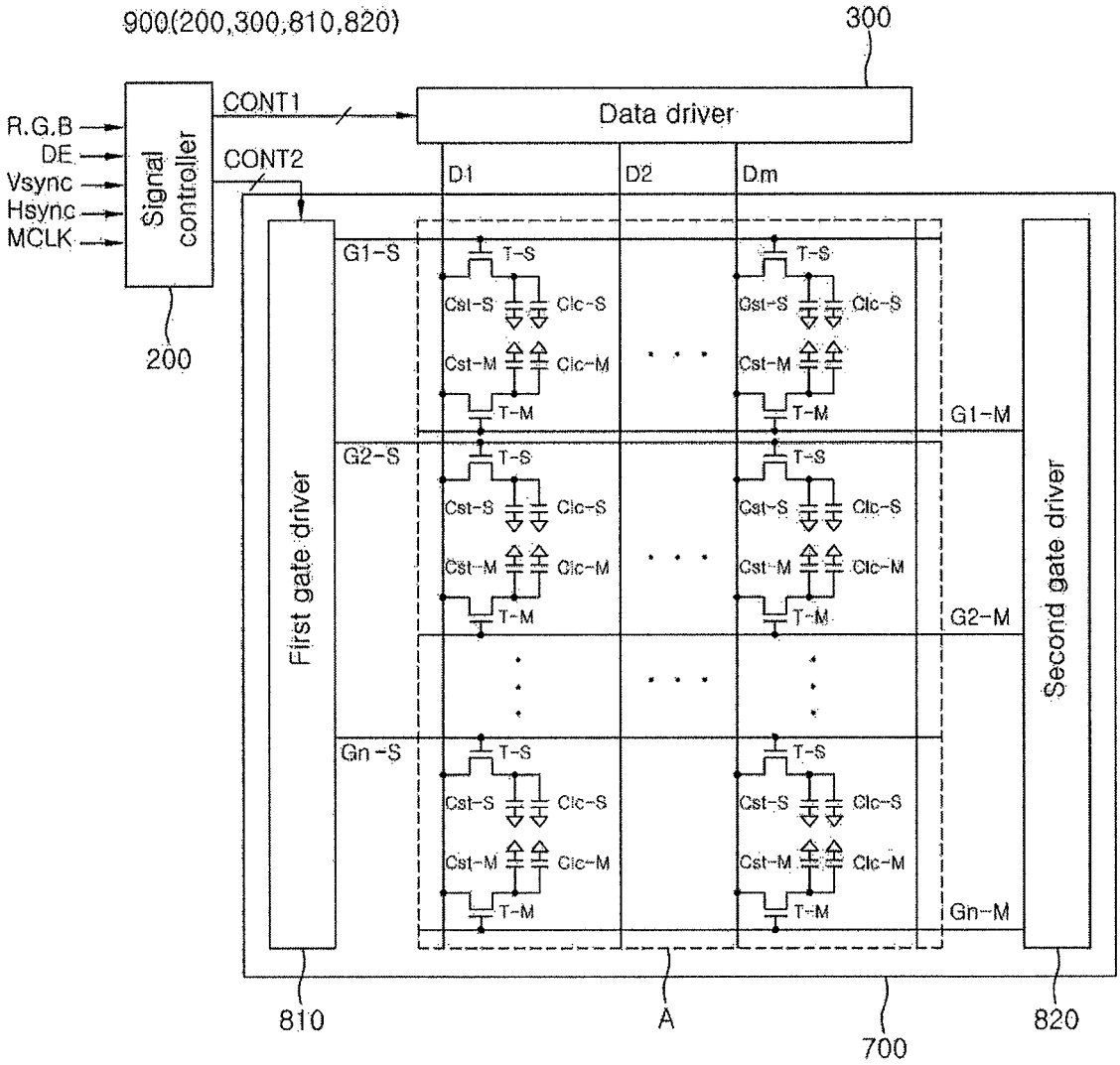
FIG. 4 is a block diagram illustrating a liquid crystal display according to a second embodiment.

FIG. 4 is a block diagram illustrating a liquid crystal display according to a second embodiment.

Referring to FIG. 4, the liquid crystal display according to this embodiment includes a liquid crystal display panel 700 having a plurality of pixels arranged in a matrix form in a display area A, and a liquid crystal driving circuit 900 for controlling operation of the pixels. The liquid crystal driving circuit 900 includes a signal controller 200, a data driver 300, and first and second gate drivers 810 and 820. The liquid crystal driving circuit 900 further includes a gradation voltage generator (not shown) for supplying a gradation voltage to the data driver 300, and a driving voltage generator (not shown) for supplying a driving voltage to the gate driver 400. Here, it is preferred that the first and second gate drivers 810 and 820 be integrally embedded in outer sides of the display area A, respectively, and formed together with the pixels in an ASG scheme.

Figure 5A:
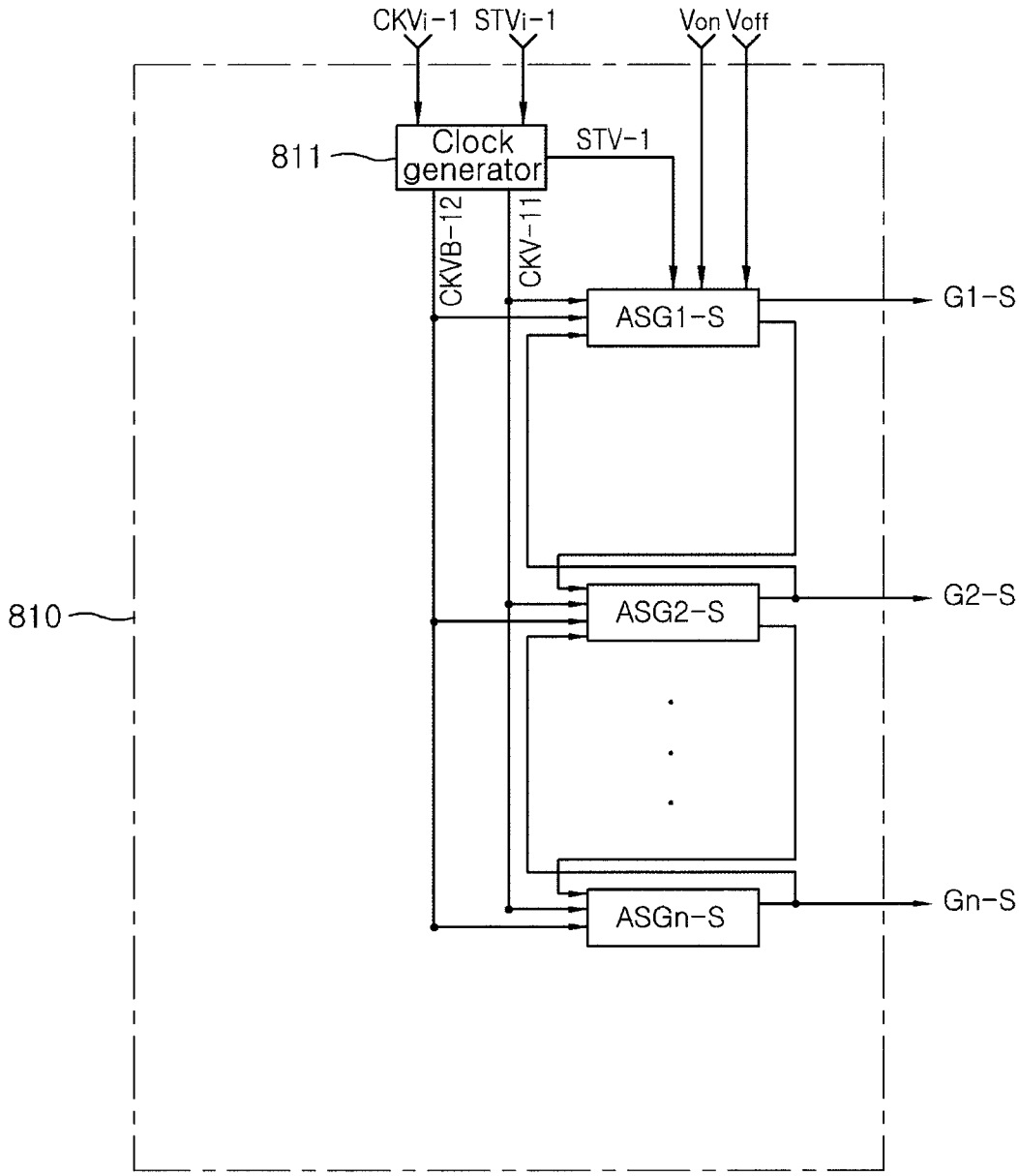
FIG. 5A is a block diagram illustrating a first gate driver according to the second embodiment.
Figure 5B:
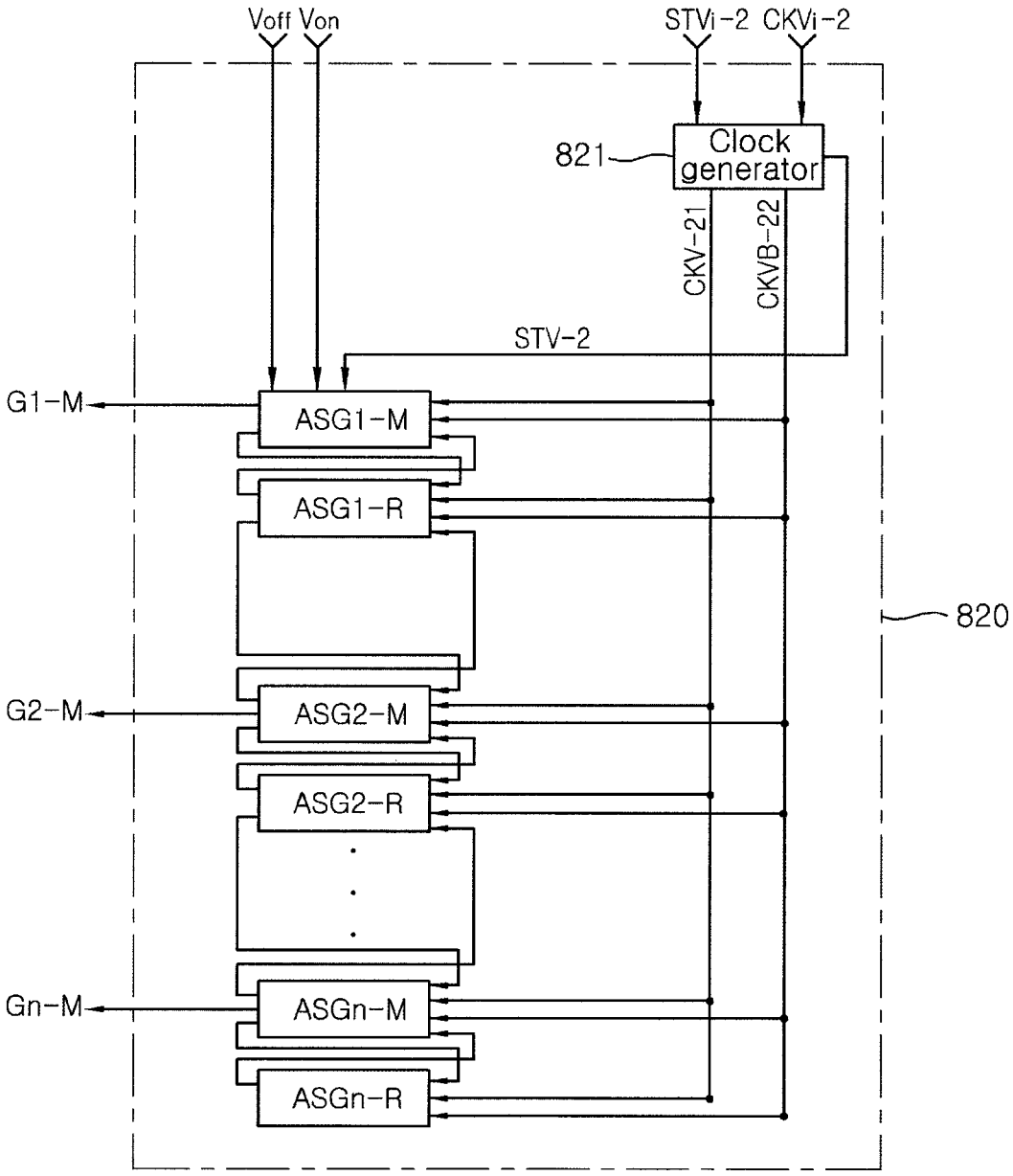
FIG. 5B is a block diagram illustrating a second gate driver according to the second embodiment.

FIG. 5A is a block diagram illustrating a first gate driver according to the second embodiment. FIG. 5B is a block diagram illustrating a second gate driver according to the second embodiment.

Referring to FIG. 5A, the first driver 810 includes a gate clock generator 811 for generating first and second internal gate clock signals CKV-11 and CKVB-12 in response to the first external gate clock signal CKVi-1 and generating a first internal vertical synchronization start signal STV-1 in response to the first external vertical synchronization start signal STVi-1, and a plurality of driving amorphous silicon gate circuits ASG1-S to ASGn-S enabled by the first internal vertical synchronization start signal STV-1 to apply gate signal to the sub gate lines G1-S to Gn-S in response to the first internal gate clock signal CKV-11 or the second internal gate clock signal CKVB-12. Referring to FIG. 5B, the second gate driver 820 includes a gate clock generator 821 for generating first and second internal gate clock signals CKV-21 and CKVB-22 in response to the second external gate clock signal CKVi-2 and generating a second internal vertical synchronization start signal STV-2 in response to the second external vertical synchronization start signal STVi-2, a plurality of driving amorphous silicon gate circuits ASG1-M to ASGn-M enabled by the second internal vertical synchronization start signal STV-2 to apply gate signals to the main gate lines G1-M to Gn-M in response to the first internal gate clock signal CKV-21 or the second internal gate clock signal CKVB-22, and a plurality of reset amorphous silicon gate circuits ASG1-R to ASGn-R for controlling a duration time of the plurality of driving amorphous silicon gate circuits ASG1-M to ASGn-M. The first and second gate drivers 810 and 820 having such a configuration are the same in operation as the gate driver 400 of the first embodiment.

In the meantime, the duration time of the gate on voltage Von of the first gate driver 810 for driving the sub pixel may be 1H, and the duration time of the gate on voltage Von of the second gate driver 820 for driving the main pixel may be ½ H (equals 1/(1+1) times H). In addition, the internal gate clock signals CKV-11 and CKVB-12 of the first gate driver 810 may have an operational frequency twice as high as that of the internal gate clock signals CKV-21 and CKVB-22 of the second gate driver 820.

In the liquid crystal display according to the second embodiment so configured, the plurality of gate drivers 810 and 820 for driving the sub pixels and the main pixels are separately disposed at opposed sides of the liquid crystal display panel 700, thereby control signal lines can be freely designed and interference between the control signal lines can be reduced. In addition, it is possible to control a charging time of a fast charging high data signal H-DATA to be shorter than that of a slow charging low data signal L-DATA, i.e., to be a half the charging time of the low data signal L-DATA as in the first embodiment. Accordingly, overcharging of the high data signal and undercharging of the low data signal can be prevented and display quality, such as side visibility and color impression, can be improved.

In the meantime, although the liquid crystal display has been illustrated as one of displays in the first and second embodiments, the present disclosure is not limited thereto but may be applied to various kinds of displays having pixel units arranged in a matrix form. For example, the concepts of the present different may be applied to various other kinds of flat panel displays, such as a plasma display panel (PDP), an organic Electro Luminescence (EL), and the like.

It is seen that according some of the teachings provided herein, driving amorphous silicon gate circuits for driving divided pixels are provided so as to be driven independently, so that gate signals can be applied to the divided pixels in a time overlapping manner. Further, reset (R) amorphous silicon gate circuits are added to succeeding stages of driving amorphous silicon gate circuits for driving some of the divided pixels, whereby gate signals applied to the divided pixels can be controlled with a different duration of ON time. Furthermore, the data signal voltages at different potentials may be applied to the plurality of divided pixels in a time-divisional manner. Thus, the charging time of each divided pixel unit can be sufficiently obtained and suitably adjusted depending on a voltage level of the data signal, thereby further improving display quality, such as side visibility and color impression.

Although the present disclosure of invention has been described in connection with the accompanying drawings and the aforementioned embodiments, the present disclosure is not to be limited thereto but is rather to be understood as encompassing variations that it will be understood by those skilled in the art in view of the present disclosure.

What is claimed is:

1. A display system, comprising:

a display panel including a plurality of pixel units, where the pixel units are arranged as a matrix having respective rows of the pixel units, each of the pixel units having at least a main subpixel and one or more subsidiary subpixels, wherein the main and subsidiary subpixels of each pixel unit are coupled to receive respective charges from a same data line associated with the given pixel unit;

a first driver for applying, by way of corresponding first gate lines, first gate signals to respective first thin film transistors used to charge and discharge the respective main subpixels; and a second driver for applying, by way of corresponding second gate lines, second gate signals to respective second thin film transistors used to charge and discharge the respective subsidiary subpixels, wherein the first and second drivers generate the respective first and second gate signals thereof independently such that the first and second gate signals can have partially time-overlapped turn-on levels, wherein each of the first and second drivers includes a respective plurality of sequentially connected shift register stages, the first driver having more shift register stages than the second driver, wherein the first driver comprises a first gate clocks generator for generating first and second main gate clock signals, said plurality of sequentially connected shift register stages of the first driver includes a plurality of first application timing circuits for timing application of turn-on levels of the first gate signals to the main subpixels in response to the first and second main gate clock signals, and the second driver comprises a second gate clocks generator for generating first and second subsidiary gate clock signals, said plurality of sequentially connected shift register stages of the second driver includes a plurality of second application timing circuits for timing application of turn-on levels of the second gate signals to the subsidiary subpixels in response to the first and second subsidiary gate clock signals, and wherein said plurality of sequentially connected shift register stages of the first driver further includes a plurality of reset timing circuits interposed between the first application timing circuits for defining a duration of turn-on drive time provided by the first application timing circuits relative to total time consumed by combination of the reset timing circuits and the first application timing circuits.

2. The display system of claim 1, wherein the reset timing circuits are not connected to drive respective gate lines, and wherein the first application timing circuits and the reset timing circuits are provided in the first driver so that each of the first application timing circuits alternates application of a gate turn-on voltage for a corresponding first duration with n consumptions of the first duration by a corresponding number n of the reset timing circuits that are not connected to drive the respective gate lines, where n is a whole number.

3. The display system of claim 2, wherein the n reset timing circuits define the duration of the turn-on drive time provided by the corresponding first application timing circuit to be 1/(n+1) of a total actuation time consumed by the first application timing circuit and the n corresponding ones of the reset timing circuits.

4. The display system of claim 1, wherein the first application timing circuits and the reset timing circuits are provided in the first driver so that the first application timing circuits and the reset timing circuits alternate with each other one by one.

5. The display system of claim 4, wherein the reset timing circuits controls a duration of turn-on drive time provided by the corresponding first application timing circuits to be ½ of a predefined horizontal line time (H) of a corresponding display.

6. The display system of claim 1, wherein odd numbered ones of the first application timing circuits in the first driver output corresponding gate turn-on signals in response to the first main gate clock signal, and even numbered ones of the first application timing circuits output corresponding gate turn-on signals in response to the second main gate clock signal.

7. The display system of claim 1, wherein odd numbered ones of the second application timing circuits in the second driver output corresponding gate turn-on signals in response to the first subsidiary gate clock signal, and even numbered ones of the second application timing circuits output corresponding gate turn-on signals in response to the second subsidiary gate clock signal.

8. The display system of claim 1, wherein the first and second main gate clock signals respectively have opposite phases.

9. The display system of claim 1, wherein the first and second subsidiary gate clock signals of the second driver have a period corresponding to one horizontal line period (H) of the corresponding display, and the first and second main gate clock signals of the first driver have a period corresponding to ½ of the horizontal line period (H).

10. The display system of claim 1, wherein the first and second drivers are provided at one side of the display panel.

11. The display system of claim 1, wherein the first and second drivers are respectively provided at opposed sides of the display panel.

12. The display system of claim 1, further comprising a signal controller for supplying first and second control signals to the first and second drivers, respectively, each of the first and second control signals including a gate clock signal and a vertical synchronization start signal.

13. The display system of claim 1, further comprising a data driver for applying data signals having different potentials respectively to the main and subsidiary subpixels of said each pixel unit in a time-divisional manner.

14. The display system of claim 13, wherein the data driver causes a first data signal level of comparatively low absolute magnitude to be charged into the subsidiary subpixel of a given pixel unit and causes a second data signal level of comparatively higher absolute magnitude to be charged into the main subpixel during a same horizontal line period (H).

15. The display system of claim 1, wherein said each pixel unit further comprises a first thin film transistor connected to a corresponding subsidiary subpixel and a second thin film transistor of equal size connected to the main subpixel.

16. A method of controlling potentials charged onto divided pixel parts of respective pixel units in a display system, wherein the pixel units are arranged as a matrix having respective rows of the pixel units, wherein each divided pixel part has a corresponding electronic switch for applying a data line signal to the divided pixel part, and wherein the corresponding electronic switch is controlled by a corresponding gate line not the same as that of other divided pixel parts of the same pixel unit and not shorted to a gate line of another row of the matrix, the method comprising:

dividing a horizontal line period (H) into a plurality of time segments;

turning on the electronic switch of a first of the divided pixel parts of a given pixel unit for a first duration defined by one or more of the time segments by using the corresponding gate line and a first shift register, the first shift register having a first plural number of shift register stages;

turning on the electronic switch of a second of the divided pixel parts of the given pixel unit for a second duration defined by a different one or more of the time segments where the second duration overlaps at least partially with the first duration by using the corresponding gate line and a second shift register which is driven independently of the first shift register, the second shift register having a second plural number of shift register stages different from that of the first shift register;

applying a first voltage to a data line of the given pixel unit during the overlap time, the data line coupling to the electronic switches of the first and second divided pixel parts; and applying a second voltage, different from the first voltage, to the data line of the given pixel unit during a part of the horizontal line period (H) when the first and second durations do not overlap, wherein said second plural number of shift register stages of the second shift register includes dummy shift stages that do not cause the electronic switch of either a first or second of the divided pixel parts to turn on but instead defines a time of nonoverlap between the first and second durations.

17. A display system, comprising:

a display panel including a plurality of pixel units, wherein the pixel units are arranged as a matrix having respective rows of the pixel units, each of the pixel units having at least a first divided pixel part and a second divided pixel part;

a first driver for applying, by way of a corresponding first gate line, a first gate signal to the first divided pixel part, the first driver having a respective first plurality of shift register stages connected sequentially one to the next; and a second driver for applying, by way of a corresponding second gate line, a second gate signal to the second divided pixel part, the second driver having a respective second plurality of shift register stages connected sequentially one to the next, wherein the first and second drivers are configured so that an on time of the first gate signal is substantially equal to a predetermined horizontal line time of a corresponding display and an on time of the second gate signal is 1/(n+1) of the predetermined horizontal line time, where n is a whole number, wherein the second plurality of shift register stages of the second driver comprises a plurality of second application timing circuits for applying second gate signals to the second divided pixel parts and a plurality of reset timing circuits, and wherein each of the second application timing circuits alternates in said sequential connecting of the stages with a predefined whole number n of the reset timing circuits.

* * * * *